US006354095B1

(12) United States Patent
Hwang

(10) Patent No.: US 6,354,095 B1
(45) Date of Patent: Mar. 12, 2002

(54) OPERATING METHOD OF ABSORPTION HEAT PUMP

(75) Inventor: Dong Kon Hwang, Seoul (KR)

(73) Assignee: LG Electronics, Inc. (KR)

( * ) Notice: Subject to any disclaimer, the term of this patent is extended or adjusted under 35 U.S.C. 154(b) by 0 days.

(21) Appl. No.: 09/495,855

(22) Filed: Feb. 1, 2000

(30) Foreign Application Priority Data

Feb. 3, 1999 (KR) ..... 99/3483

(51) Int. Cl.[7] ..... F25B 15/00
(52) U.S. Cl. ..... 62/141; 62/476
(58) Field of Search ..... 62/141, 476, 483, 62/485, 489

(56) References Cited

U.S. PATENT DOCUMENTS 3,626,711 A * 12/1971 Porter et al.
4,269,034 A * 5/1981 Rzechula ..... 62/141
4,270,365 A * 6/1981 Sampietro
4,364,240 A * 12/1982 Schulz et al. ..... 62/476 X
4,596,122 A * 6/1986 Kantner ..... 62/141
4,691,525 A * 9/1987 Gelderloos ..... 62/141 X
5,572,884 A * 11/1996 Christensen et al. ..... 62/476 X
5,927,086 A * 7/1999 Suzuki et al. ..... 62/141

FOREIGN PATENT DOCUMENTS

JP 406050626 * 2/1994

* cited by examiner

*Primary Examiner*—Henry Bennett
*Assistant Examiner*—Chen-Wen Jiang
(74) *Attorney, Agent, or Firm*—Ostrolenk, Faber, Gerb & Soffen, LLP

(57) ABSTRACT

An operation method of an absorption heat pump is disclosed. This method includes a step for measuring a temperature of a refrigerant vapor passed through the above-described rectification process, a step for comparing the measured temperature and a previously set temperature and estimating a refrigerant density passed through the rectification process, and a step for controlling a heat exchange amount between a rich solution and a refrigerant vapor during the rectification process based on the estimated refrigerant density for thereby obtaining a high purity and density of a refrigerant vapor and a high and stable COP even when a load and an outdoor temperature are changed by changing the amount of a heat exchange performed by a rectifier in accordance with the density of a refrigerant estimated by a temperature of a refrigerant vapor flown into a condenser.

7 Claims, 4 Drawing Sheets

OPERATING METHOD OF ABSORPTION HEAT PUMP

BACKGROUND OF THE INVENTION

1. Field of the Invention

The present invention relates to an operating method for an absorption heat pump, and in particular to an operating method of an absorption heat pump which is capable of obtaining a stable and high COP(Coefficient Of Performance) by changing a heat exchange amount using a filter based on a density estimated by a temperature of a refrigerant vapor flown into a condenser and obtaining a high purity and density of a refrigerant vapor.

2. Description of the Background Art

Generally, an absorption heat pump uses a LNG, LPG, gasoline, etc. as a heat source unlike a vapor compression type pump which uses an electric power as a heat source. The above-described absorption heat pump is a cooling, warming and heating system by generating a cooled or heated water based on a heat driven heat pump using a combustion heat as a heat source.

As an example of an absorption heat pump, FIG. 1 illustrates the construction of a conventional ammonia GAX (Generator Absorber heat eXchanger) which uses an ammonia solution as an absorbing agent.

The operation that the ammonia GAX absorption heat pump is operated based on a cooling cycle as shown in Figure will be explained. First, when the heat generated by a burner(not shown) is transferred to a gas direct burning generator 1, a rich solution having a high ammonia density is heated and is changed to a refrigerant vapor and dilute solution. The thusly generated refrigerant vapor is flown into an analyzer 3 and a rectifier 4 installed above the solution heat exchanger 2 for increasing a refrigerant density through the solution heat exchanger 2 installed above a direct-fired type generator 1 in order to decrease the load of the generator 1.

In detail, in the above-described heating operation, since a difference between the heating points of the ammonia and water is small, the ammonia and water are heated together, so that a filtering process for removing a vapor component from the refrigerant vapor is adapted so as to use a pure ammonia as a refrigerant. The analyzer 3 and rectifier 4 are used to implement the above-described filtering operation.

The refrigerant vapor passed through the solution heat exchanger 2 is flown into the interior of the analyzer 3 filled with a filling agent and contacts with a low temperature rich solution supplied from a water cooling absorber 5 to the analyzer 3 through the rectifier 4, so that a vapor component is condensed.

The refrigerant vapor condensed as the vapor component is condensed is flown into the interior of the rectifier 4. At this time, the vapor component which is not condensed by the analyzer 3 by a heat exchange with the low temperature rich solution supplied from the water cooling absorber 5 to the rectifier 4 through the solution pump 6 is condensed, so that the refrigerant vapor is filtered.

The refrigerant vapor flown into the condenser 7 through the above-described filtering operation is condensed into a liquid refrigerant based on a heat exchange with a cooling water by the condenser 7 and is flown into a pre-cooler 8.

Continuously, the refrigerant vapor has a temperature decreased to the vapor temperature of the evaporator 9 by a heat exchange with the refrigerant vapor passed through the evaporator 9 and passes through an expansion valve 14 and is flown into the evaporator 9 in a vapor state. Thereafter, the temperature is increased by an indoor unit(not shown), and the refrigerant is vaporized by a heat exchange with a cooled water flown into the evaporator 9.

At this time, the cooled water having a temperature decreased by an evaporation latent heat is flown into the indoor unit and decreases the temperature of the air of the indoor.

Thereafter, The refrigerant vapor vaporized by the vaporizer 9 is flown into the pre-cooler 8, and the temperature of the same is increased up to the temperature of a condensing liquid from the condenser 7 by a heat exchange with the liquid state refrigerant condensed by the condenser 7 and is flown into the GAX 10, the solution cooling absorber 12, and the water cooling absorber 5.

In addition, the solution remained by generating a refrigerant, namely, the dilute solution having a low ammonia density is flown into the solution heat exchanger 2 and is heat-exchanged with a rich solution which is downwardly flown, so that the temperature is decreased. Thereafter, the resultant solution is flown into the GAX 10 in a state that the pressure of the same is decreased by a pressure decreasing valve 11 and passes through the GAX 10, the solution cooling absorber 12, and the water cooling absorber 5 and absorbs a refrigerant vapor from the evaporator 9 and is changed into a rich solution having a high density ammonia.

In detail, the dilute solution which absorbs a refrigerant vapor at the GAX 10 and the solution cooling absorber 12 has a temperature decreased by a heat exchange with the rich solution circulated by the solution pump 6 through the water cooling absorber 5. The temperature of the same is further decreased by a heat exchange with a cooled water passed through a radiator(not shown) in the water cooling absorber 5.

In addition, the rich solution generated by the water cooling absorber 5 is supplied to the rectifier 4 by the solution pump 6, and the flowing amount of liquid is properly controlled by a flowing liquid amount control three-way valve 13 and is flown into the solution cooling absorber 12 and the analyzer 3.

In detail, the rich solution flown into the solution cooling absorber 12 is heated and boiled by an absorption heat generated when a refrigerant vapor is absorbed into the dilute solution, and a vapor state liquid is supplied to the upper portion of the solution heat exchanger 2. A part of the liquid is heat-exchanged with the dilute solution flowing in the solution heat exchanger 2, so that the temperature of the same is increased, and the liquid is downwardly flown in the direction of the generator 1.

The rich solution flown toward the upper portion of the analyzer 3 contacts with a refrigerant vapor upwardly moving from the generator 1 and absorbs a part of the vapor included in the refrigerant vapor and filters the same and is downwardly flown in the direction of the generator 1.

Therefore, the above-described operation is repeatedly performed during the operation of the system.

On the contrary, in the heating cycle operation, the flowing direction of the cooling water is changed and is flown toward the radiator(not shown) of the outdoor unit through the evaporator 9. The cooling water is flown toward the indoor unit through the condenser 7 and the cooling water absorber 5. At this time, the high temperature water which absorbed the condensing heat and absorption heat radiates heat in the indoor unit, so that an indoor air is heated for thereby performing a heating operation.

In the above-described absorption heat pump, the cooling COP and heating COP are greatly changed in accordance with the density of the refrigerant vapor flown from the rectifier to the condenser.

As shown in FIG. 2, when the density of the ammonia used as a refrigerant is 97%, the cooling COP is 0.65, and the heating COP is 1.55. When the density of the ammonia is 99%, the cooling COP is 0.74, and the heating COP is 1.64.

Namely, as the density of the ammonia is increased by 2%, the cooling COP is increased by 13%, and the heating COP is increased by 5%.

Therefore, in order to obtain an excellent performance, the rectifier which is capable of increasing the density of the refrigerant is important. The density of the refrigerant preferably has above 99.5%.

However, in the conventional absorption heat pump, if the load or outdoor temperature is changed, the density of the ammonia, namely, the density of the refrigerant is decreased, so that the COP of the system is decreased.

FIG. 3 illustrates a density variation characteristic of the refrigerant vapor and liquid refrigerant from an inlet portion to an outlet portion of the evaporator.

In this case, if the refrigerant density is low, it means that a lot amount of water components($H_2O$) is included in the liquid refrigerant flown into the evaporator.

Therefore, in the evaporator structure in which a refrigerant is flown from the lower portion of the heat exchange coil and flown to the upper portion of the same, when the system operates for long time, the water components are gathered at the lower portion, so that the density(purity) of the refrigerant is decreased for thereby decreasing the performance of the evaporator, whereby a bleeding phenomenon occurs.

In addition, in order to prevent the bleeding phenomenon, the water component gathered at the lower portion of the evaporator must be manually removed.

SUMMARY OF THE INVENTION

Accordingly, it is an object of the present invention to provide an operation method of an absorption heat pump capable of obtaining a high purity and density of a refrigerant vapor and a high and stable COP even when a load and an outdoor temperature are changed by changing the amount of a heat exchange performed by a rectifier in accordance with the density of a refrigerant estimated by a temperature of a refrigerant vapor flown into a condenser.

To achieve the above objects, there is provided an operation method of an absorption heat pump according to the present invention which includes a step for measuring a temperature of a refrigerant vapor passed through the above-described rectification process, a step for comparing the measured temperature and a previously set temperature and estimating a refrigerant density passed through the rectification process, and a step for controlling a heat exchange amount between a rich solution and a refrigerant vapor during the rectification process based on the estimated refrigerant density.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The operation method of an absorption heat pump according to the present invention will be explained with reference to the accompanying drawings.

Figure 1:
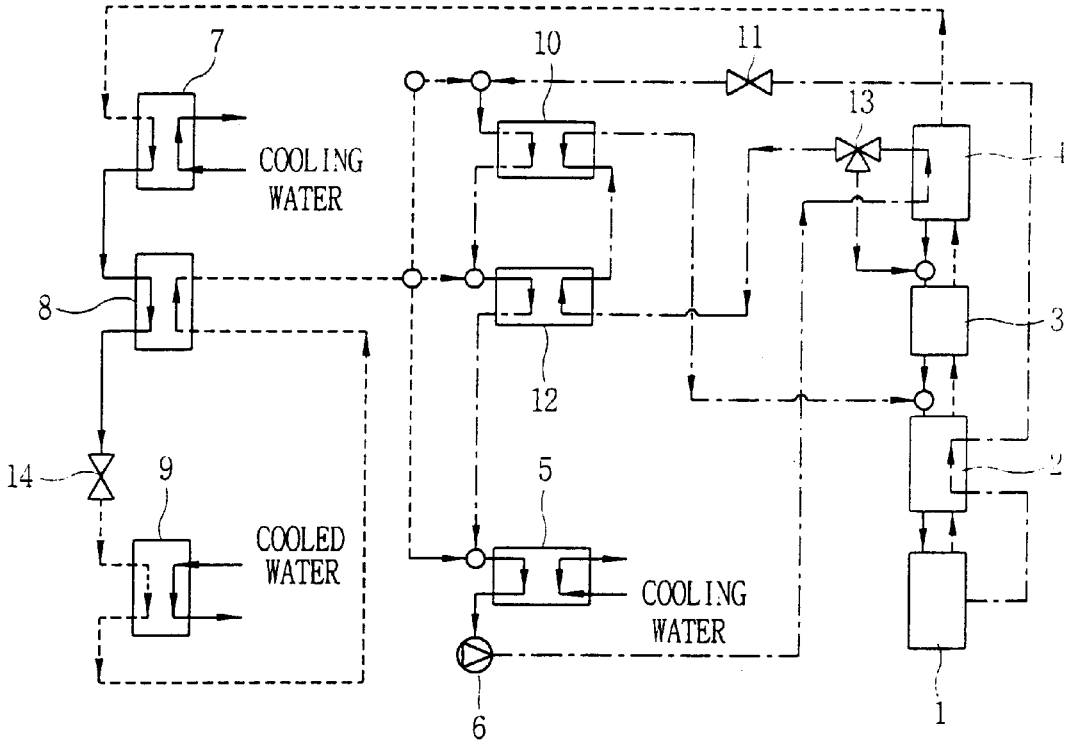
FIG. 1 CONVENTIONAL ART
FIG. 1 is a view illustrating the construction of a conventional ammonia GAX absorption heat pump.
Figure 2:
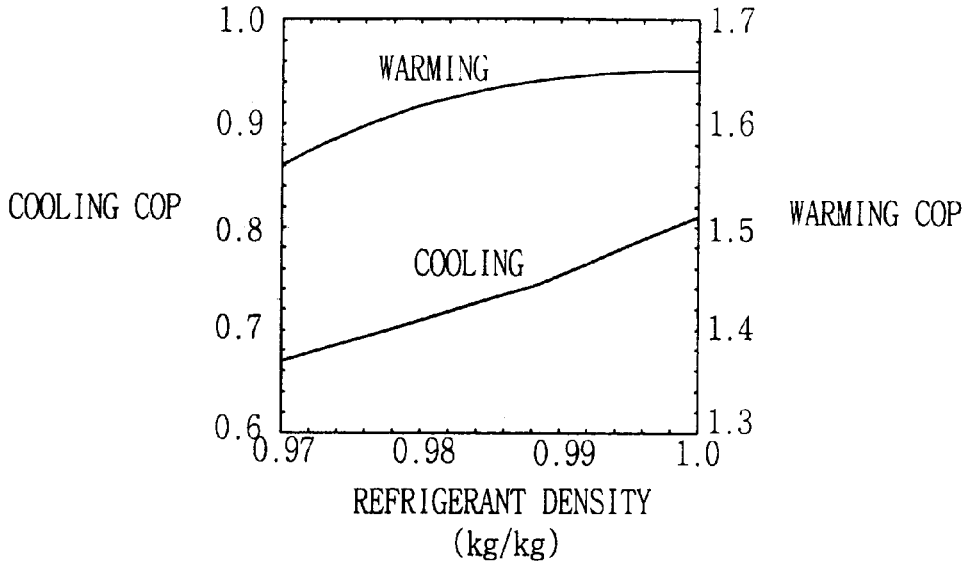
FIG. 2 is a graph between an ammonia density and a COP(Coefficient Of Performance)
Figure 3:
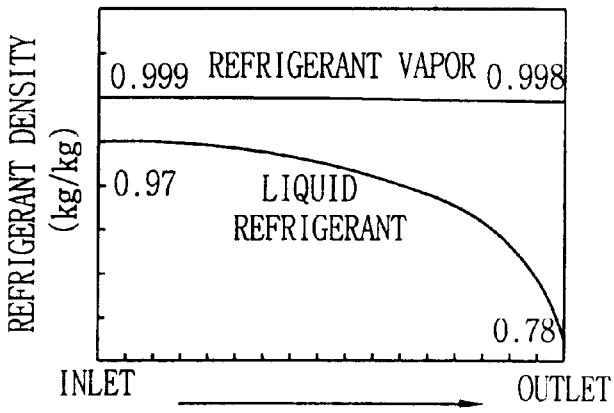
FIG. 3 is a graph of a density variation characteristic graph in an evaporator.

The same elements as the elements illustrated in FIG. 1 are given the same reference numerals, and the description thereon will be omitted.

The present invention may be adapted to various products which are capable of performing a cooling or heating operation based on a rectification, condensing operation, vaporization, and absorption operation.

Figure 4:
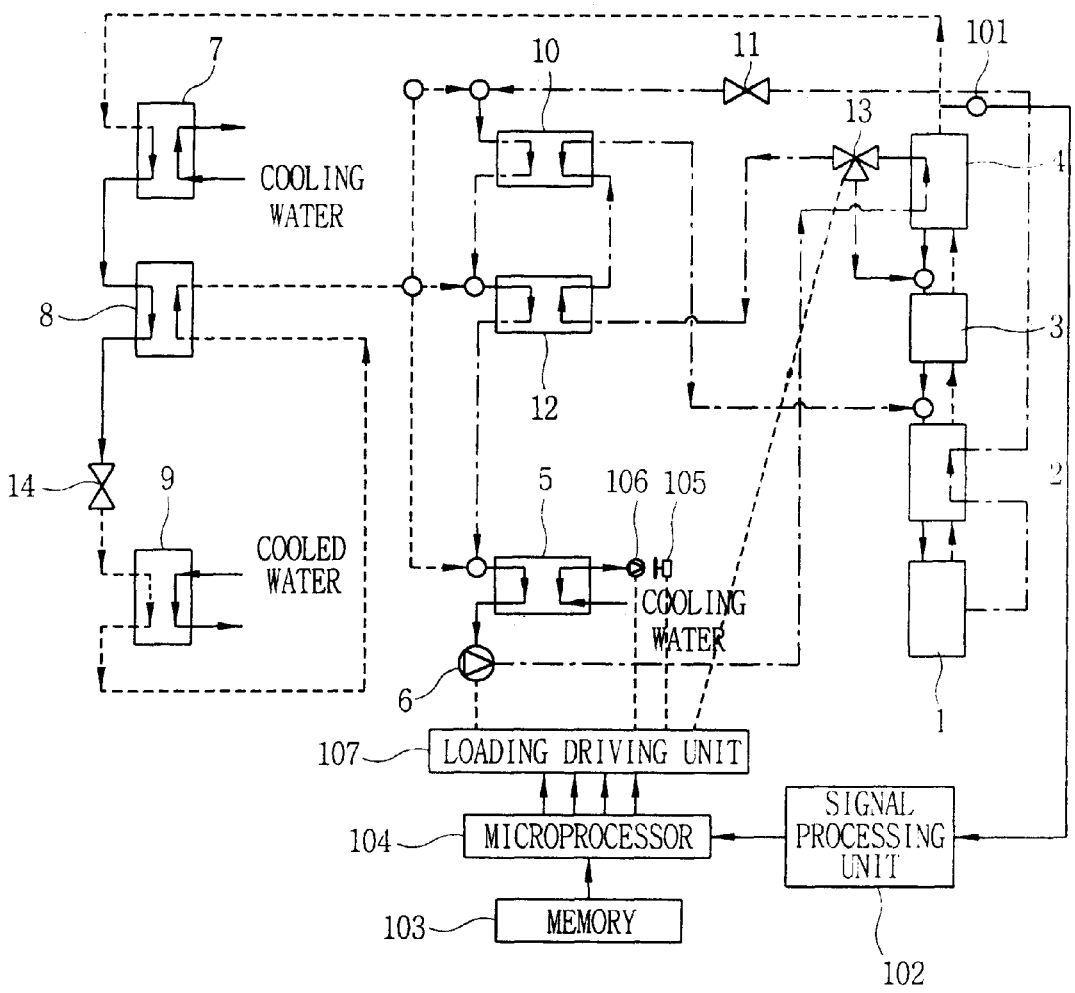
FIG. 4 is a view illustrating the construction of an absorption heat pump and a control apparatus thereof for performing an operating method of an absorption heat pump according to the present invention.

FIG. 4 illustrates an absorption heat pump and a control apparatus for performing an operation method of an absorption heat pump according to the present invention. In the following description, an ammonia GAX absorption heat pump will be explained.

As shown in FIG. 4, the control apparatus of an absorption heat pump according to the present invention includes a thermistor 101 having a resistance value varied in accordance with a temperature variation of a refrigerant vapor flown from a rectifier 4 to a condenser 7, a signal processing unit 102 for wave-rectifying an output signal of the thermistor 101, a microprocessor 104 for comparing a temperature measurement signal of the refrigerant vapor flown from the signal processing unit 102 with a temperature reference data stored in a memory 103, estimating a density of the refrigerant vapor, and outputting various control signals, a solution pump 6 for pumping a rich solution from the lower portion of a water cooling absorber 5 to the rectifier 4, a flowing liquid amount control three-way valve 13 for dividing the rich solution from the rectifier 4 into two directions of a solution cooling absorber 12 and an analyzer 3, a cooling fan 105 for radiating the heat exchanged with the rich solution of the water cooling absorber 5, and a load driving unit 107 for driving the above-described loads in accordance with a control of the microprocessor 104.

The operation method of the absorption heat pump which is implemented by the above-described control apparatus according to the present invention will be explained with reference to the accompanying drawings.

The measurement data shown in FIG. 5 will be explained. In the case that the pressure is 21 bar, when the density of the refrigerant flown from the rectifier 4 to the condenser 7 is 99.7%, the temperature of the same is about 70° C., and when the density of the refrigerant is decreased, and then the density is decreased to 97.5%, the temperature is increased based on a two-dimensional function, so that the temperature becomes about 100° C.

Therefore, in the state that the pressure is constant, when the density of the refrigerant flown from the rectifier 4 to the condenser 7 is decreased, it means that the refrigerant is over-heated.

Figure 5:
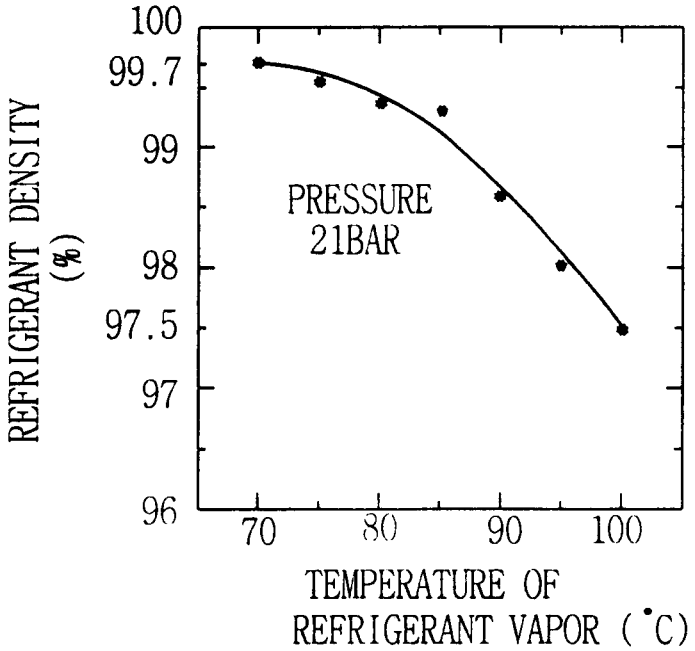
FIG. 5 is a graph between a density and a temperature of a refrigerant.

In the present invention, the density of the refrigerant vapor is estimated using a characteristic between the density and temperature as shown in FIG. 5 by checking the temperature of the refrigerant vapor flown from the rectifier 4 to the condenser 7. Thereafter, a high purity and density of the refrigerant vapor is maintained by properly changing the heat exchange amount, namely, the heat exchange amount between the rich solution and the refrigerant vapor during the rectifying process of the rectifier 4 and the analyzer 3.

In detail, the operation method of the absorption heat pump according to the present invention is directed to measuring the temperature of the refrigerant vapor passed through the rectifying process using the thermistor 101 installed between the rectifier 4 and the condenser 7.

At this time, the thermistor 101 has a certain resistance value and an output signal of the thermistor 101 is wave-smoothed by the signal processing unit 102 and is applied to the microprocessor 104.

The microprocessor 104 compares a temperature measuring signal of the refrigerant vapor inputted from the signal processing unit 102 and a temperature reference data stored in the memory 103 for thereby estimating the temperature of the refrigerant vapor which passed through the rectifying process, so that various control signals are outputted to the load driving unit 107 for thereby driving the loads.

At this time, in the case that the density of the refrigerant vapor is decreased below a certain level based on a variation of the load or outdoor temperature, the microprocessor 104 properly increase a heat exchange amount between the rich solution and refrigerant vapor by the rectifier 4 and the analyzer 3, so that more than one load of the solution pump 6, the liquid flowing amount control three-way valve 13, the cooling fan 105 and the water cooling pump 106.

The operation for controlling the loads using each element will be explained.

First, when increasing the rotation of the solution pump 6, the flowing amount of the rich solution pumped from the lower portion of the water cooling absorber 5 to the rectifier 4 is increased, so that a heat exchange amount between the refrigerant vapor and rich solution flowing upwardly through the analyzer 3 is increased.

Second, when increasing the opened degree at the side of the analyzer 3 of the liquid flowing amount control three-way valve 13, the amount of the rich solution flowing to the upper portion of the analyzer 3 through the rectifier 4 is increased, so that a heat exchange amount between the refrigerant vapor and the rich solution flowing upwardly through the solution heat exchange unit 2 is increased.

Third, when increasing the rotation of the cooling fan 105, the heat amount of the cooling water passing through a radiator(not shown) is increased, so that the temperature of the cooling water is decreased, and the heat exchange amount between the rich solution and cooling water of the water cooling of the rectifier 4 is increased.

Fourth, when increasing the rotation of the cooling water pump 106, the flowing speed of the cooling water passing through the radiator(not shown) is increased, so that a heat exchange amount between the rich solution and cooling water of the water cooling absorber 5 is increased. At the same time, the temperature of the rich solution pumped from the lower portion of the water cooling absorber 5 to the rectifier 4 is decreased, so that a heat exchange amount between the refrigerant vapor and rich solution of the rectifier 4 is increased.

When the heat exchange amount is increased due to the above-described rectification process, the temperature of the refrigerant vapor flowing from the rectifier 4 to the condenser 7 is increased, a high purity and density refrigerant is obtained, and a stable and high COP of the system is obtained.

As described above, in the operation method of the absorption heat pump according to the present invention, it is possible to obtain a high purity and density refrigerant flowing from the rectifier to the condenser by properly controlling a heat exchange amount during the rectification operation, so that a high and stable COP of the system is obtained.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. In an operation method for performing a cooling and heating operation based on rectification, condensing, evaporation and absorption operations of a refrigerant in a system including a generator for boiling a rich solution therein, a solution heat exchanging unit, analyzer and a rectifier installed above the generator, a water cooling absorber communicating with the rectifier, and a radiator communicating with the water cooling absorber, an operation method of an absorption heat pump, comprising the steps of:

a step for measuring a temperature of the refrigerant vapor passed through the above-described rectification process;

a step for comparing the measured temperature and a previously set temperature and estimating a refrigerant density passed through the rectification process; and a step for controlling a heat exchange amount between a rich solution and the refrigerant vapor during the rectification process based on the estimated refrigerant density.

2. The method of claim 1, wherein said refrigerant vapor is a refrigerant vapor before a condensing process is performed.

3. The method of claim 1, wherein the control of the heat exchange amount is implemented by controlling the flowing amount of the rich solution or the temperature of the rich solution.

4. The method of claim 3, wherein the heat exchange amount is controlled by increasing the amount of a heat exchange between the refrigerant vapor and the rich solution upwardly moving through the analyzer by increasing the flowing amount of the rich solution of a low temperature pumped from the lower portion of the water cooling absorber to the rectifier.

5. The method of claim 3, wherein the heat exchange amount is controlled by increasing the amount of a heat exchange between the refrigerant vapor and the rich solution upwardly moving through the solution heat exchanger by increasing the amount of the rich solution upwardly moved to the upper portion of the analyzer through the rectifier.

6. The method of claim 3, wherein the heat exchange amount is controlled by increasing the amount of a heat exchange between the rich solution and cooling water of the water cooling absorber by increasing the amount of a radiation of the cooling water passing through the radiator and decreasing the temperature of the cooling water and increasing the amount of a heat exchange between the refrigerant vapor and the rich solution of the rectifier by decreasing the temperature of the rich solution pumped from the lower portion of the water cooling absorber to the rectifier.

7. The method of claim 3, wherein the heat exchange amount is controlled by increasing the amount of a heat exchange between the rich solution and cooling water of the water cooling absorber by increasing a flowing speed of the cooling water passing through the radiator and increasing the amount of a heat exchange between the refrigerant vapor and the rich solution of the rectifier by decreasing the temperature of the rich solution pumped from the lower portion of the water cooling absorber to the rectifier.

* * * * *